United States Patent [19]

Webster

[11] Patent Number: 5,060,335

[45] Date of Patent: Oct. 29, 1991

[54] APPARATUS FOR CLEANING THE SURFACE OF A RAILWAY RAIL

[76] Inventor: Richard Webster, 6 N 332 Keeney Rd., Keeneyville, Ill. 60172

[21] Appl. No.: 635,246

[22] Filed: Dec. 28, 1990

[51] Int. Cl.[5] ..... E01H 8/10

[52] U.S. Cl. ..... 15/97.1; 15/54; 15/103.5; 104/279

[58] Field of Search ..... 15/54, 55, 97.1, 103.5, 15/98; 51/178; 104/279

[56] References Cited

U.S. PATENT DOCUMENTS 2,475,771 7/1949 Wittner ..... 15/54 X

*Primary Examiner*—Edward L. Roberts

*Attorney, Agent, or Firm*—Douglas B. White

[57] ABSTRACT

The present invention incorporates a caged roller transported along a railroad track by a railroad car adapted for the purpose. The roller is covered with a fluid retaining wear resistant layer which contacts the rail surface. Rolling motion of the roller is generated by movement of the cage along the track and wiping action is caused by retarding rolling motion by contact of the roller with the rear portion of the cage. In a further feature the motion of the roller may be additionally retarded by providing in the interior of the roller a quantity of particulate matter to increase rolling resistance and the weight of the roller.

10 Claims, 2 Drawing Sheets

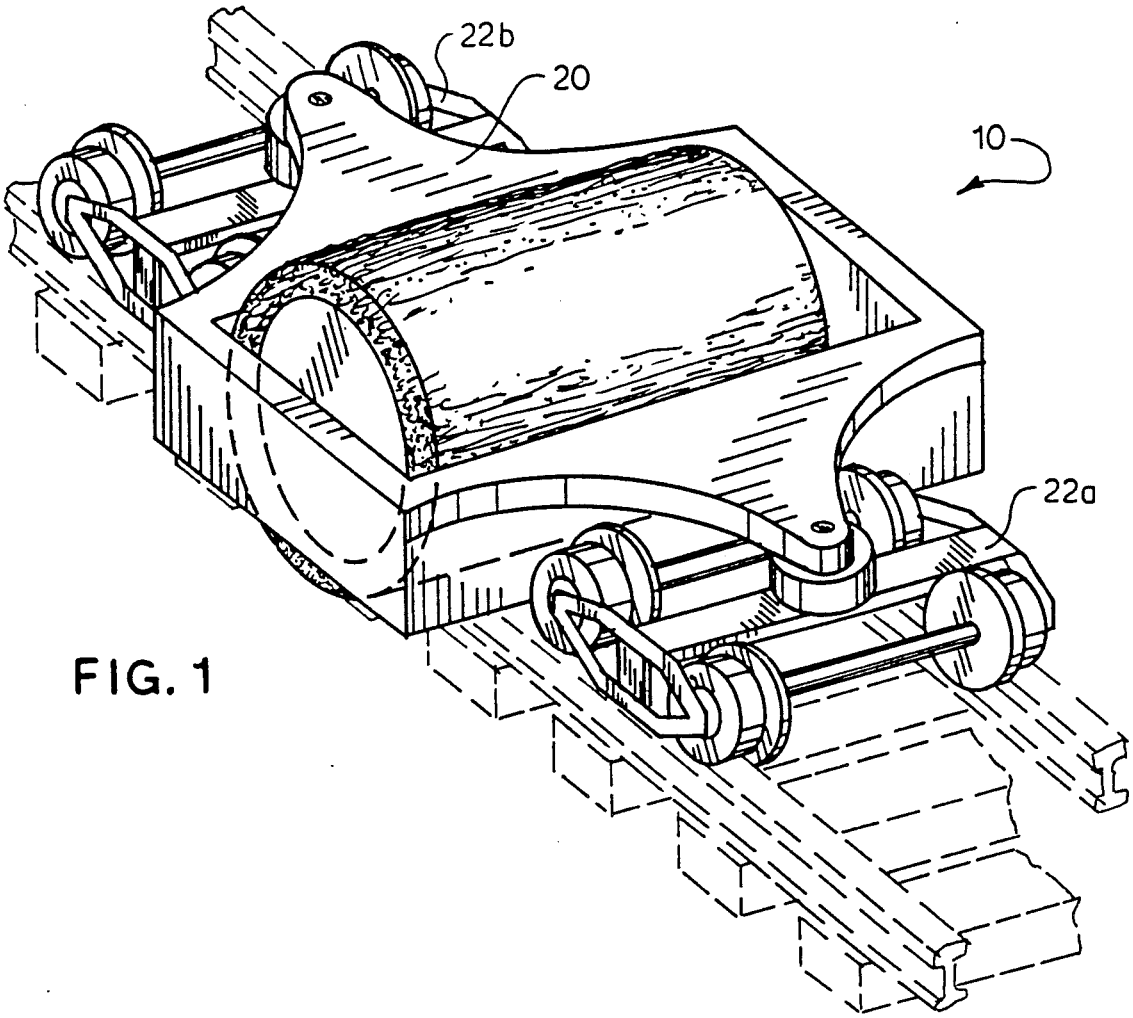
FIG. 1
FIG. 2
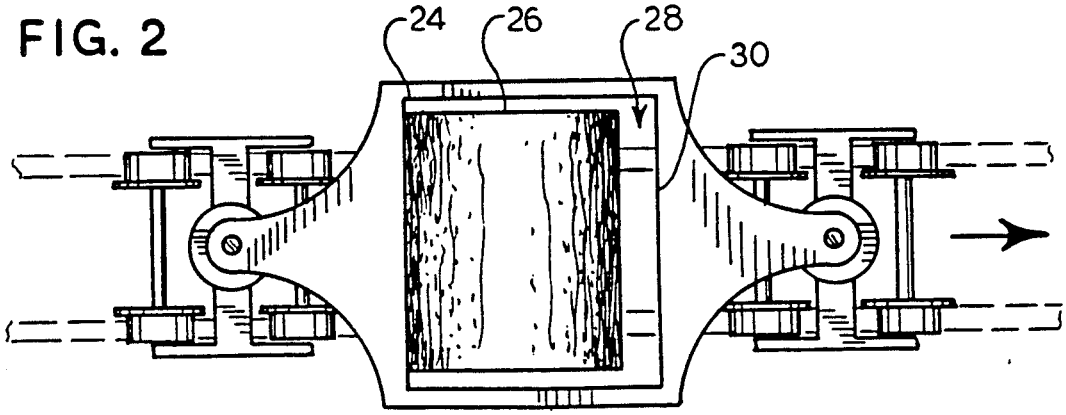

FIG. 3
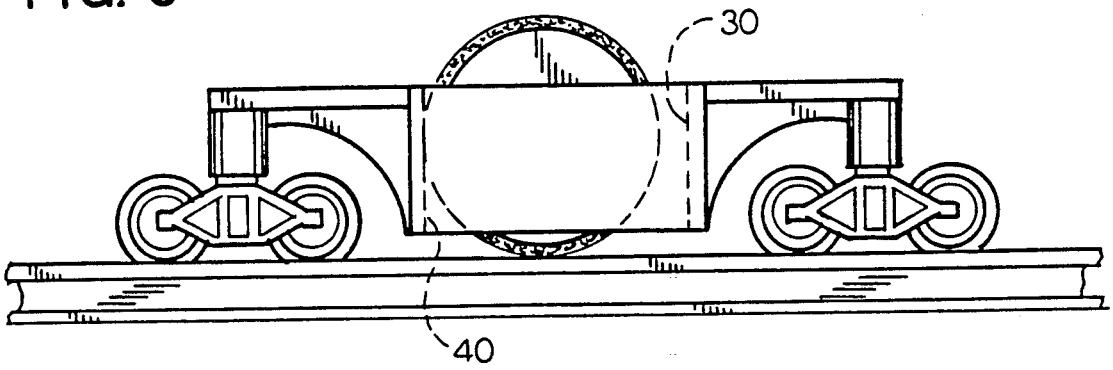
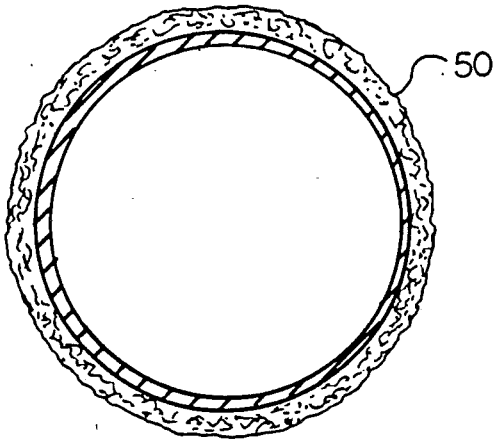
FIG. 4
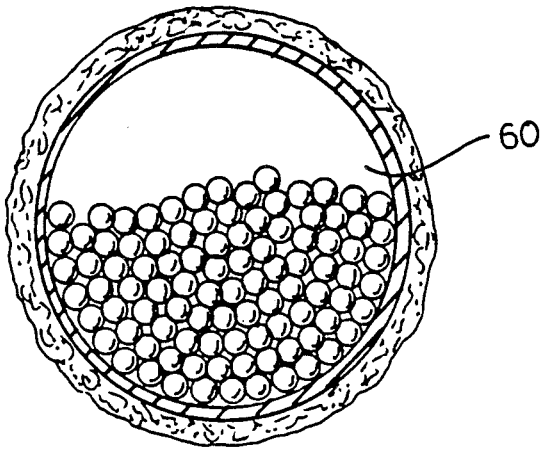
FIG. 5

APPARATUS FOR CLEANING THE SURFACE OF A RAILWAY RAIL

BACKGROUND OF THE INVENTION

1. Field of the Invention

The present invention relates generally to rail cleaning equipment designed for maintaining the contact surface of the rails of a railway in a sufficiently clean condition to ensure adequate traction and electrical contact. The apparatus of this invention relates specifically to an improvement in a track wiping technique and has equal applicability to both full size railroads and miniaturized model railroads.

2. Description of the Prior Art

The cleaning of rails has been a necessity since the development of the railroads. Grease, oil and other contaminants will generally accumulate on the rail during use and eventually this accumulation will interfere with traction and electrical contact to the tracks.

Rail cleaners currently in use fall into two classes: they either grind the tracks or wipe the tracks. Track grinders require a motorized unit having an abrasive rotating surface positioned for removing a top surface layer from the rail. Quite understandably this not only limits the life of the track but it also leaves a gritty residue on the rail surface. While the wiping pad technique does not leave such a residue, it suffers from other drawbacks. Since the pads are spring loaded against the weight of the car, the possibility of derailment is increased. But even more frequently, small irregularities on the rail snag the wiping device and damage or break the mechanism.

SUMMARY OF THE INVENTION

It is therefore a principle object of the present invention to provide an apparatus for cleaning the surface of rails which produces a controlled wiping action but which is not subject to the snagging and breaking inherent in the prior art.

It is a further object to provide such wiping apparatus which scrubs the rail by producing a controlled slip on the rails, yet yields upon encountering an irregularity in the rail.

It is yet another object to provide a rail cleaning apparatus which facilitates the carrying of a solvent fluid on the wiping surface to assist the cleaning function.

The present invention incorporates a caged cylindrical roller transported along a track by a railroad car adapted for the purpose. The roller is covered with a fluid retaining wiping layer which contacts the rail surface. During transport the roller is in contact with the rear of the cage, and this contact acts to retard its rolling motion, to produce a controlled slip and roll. In a further feature the motion of roller may be additionally retarded by inserting particulate matter into the interior of the roller to increase its rolling resistance.

BRIEF DESCRIPTION OF THE DRAWINGS

FIG. 1 is a perspective view of the rail cleaning apparatus of the present invention.

FIG. 2 is a top view of the rail cleaning apparatus of FIG. 1.

FIG. 3 is a side view of the rail cleaning apparatus of FIG. 1.

FIG. 4 is a cross section view of one embodiment of the roller member of the rail cleaning apparatus.

FIG. 5 is a cross section view of a second embodiment of the roller member of the rail cleaning apparatus.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Turning first to FIG. 1 a railcar 10 is shown positioned on a railway and is adapted to employ rail cleaning apparatus in accordance with the present invention. Particularly, a frame member 20 is mounted to a railcar wheel suspension 22*a* and 22*b* to form a cage for transporting a wiping roller as hereinafter described.

Positioned within the frame is a rectangularly shaped pocket 24 dimensioned to accept and cage a roller 26 such that clearance 28 is provided along the forward edge 30 of the pocket. As shown in FIGS. 1–3, the roller is constrained to roll within the pocket during transport of the railcar and is pushed along by the rear inside face 40 of the pocket when the railcar is transported along the track.

The roller 26 is, in its simplest form, a cylindrical member, with either a solid or hollow interior, and is of sufficient weight to maintain contact with the rail. An outer absorbent covering 50 is provided over the surface of the roller. This covering performs two functions, it carries a fluid having cleaning or solvent properties, and it scrubs the rail during transport. A suitable covering generally comprises a fabric composition and should be chosen to present adequate wear resistance as well as the desired absorbent capacity. In the model railroad version of this rail cleaner a soft fabric, or simply paper toweling, will suffice to hold the cleaning solvent and to scrub the rails during operation without appreciable degradation during use.

The cleaning apparatus of the present invention is passive in nature, and is operated by simply transporting the railcar 10 along the railway. When the railcar 10 is pulled along the railway, contact between the roller and the rail allows the cleaning solvent to remove grease, oil and dirt on the rail. But more importantly, the rear face of the pocket retards the rolling motion of the roller and this causes the roller to slide relative to the rails and thereby provide a scrubbing action along the rails. When irregularities in the rails are encountered, the roller does not catch or snag, but pressure from contact with the irregularity overcomes the slippage resistance to cause a rolling movement. Once past the irregularity, controlled slippage resumes.

In a further embodiment, slippage resistance is increased by adding to the interior of the cylinder, heavy particulate matter 60 (FIG. 5), such as lead shot. This further impedes rolling and increases the contact force, to increase scrubbing action on the rail. As before, any irregularity or potential snag simply causes the cylinder to roll until the rail is smooth enough for slippage to resume.

From the foregoing description, it will be apparent that modifications can be made to the apparatus and method for using same without departing from the teachings of the present invention. Accordingly, the scope of the invention is only to be limited as necessitated by the accompanying claims.

I claim:

1. Apparatus for cleaning the surface of the rails of a railroad track assembly comprising:

roller means for providing a wiping contact with the rails;

cage means for guiding said roller means to allow rolling movement thereof along the rails, said cage means being arranged to be transported along the railroad track; and means for retarding the rolling movement of said roller means.

2. The apparatus of claim 1 wherein said roller means comprises a member of substantially cylindrical shape positioned to span across both rail surfaces of the track assembly.

3. The apparatus of claim 2 wherein said cylindrical member exhibits a hollow interior.

4. The apparatus of claim 3 further comprising particulate material within said interior of said cylindrical member for retarding the rolling motion of said cylindrical member.

5. The apparatus of claim 2 further comprising a covering on the outer surface of said roller means.

6. The apparatus of claim 5 wherein said covering exhibits absorbent characteristics for holding a solvent fluid.

7. The apparatus of claim 2 wherein said cage means comprises a railcar having a rectangular opening therein for providing constraint on said roller means, and wherein contact between said cage means and said roller comprises said means for retarding the rolling motion of said roller means.

8. The apparatus of claim 7 further comprising a covering on the outer surface of said roller means.

9. The apparatus of claim 8 wherein said covering exhibits absorbent characteristics for holding a solvent fluid.

10. The apparatus of claim 9 wherein said cylindrical member exhibits a hollow interior and further comprises particulate matter within said interior for causing additional retardation of the rolling motion of said cylindrical member.

* * * * *